US010024556B2

(12) United States Patent
Choi et al.

(10) Patent No.: US 10,024,556 B2
(45) Date of Patent: Jul. 17, 2018

(54) OUTDOOR UNIT OF AIR CONDITIONER, COOLING UNIT APPLIED THERETO, AND METHOD FOR MANUFACTURING COOLING UNIT

(71) Applicant: SAMSUNG ELECTRONICS CO., LTD., Suwon-si, Gyeonggi-do (KR)

(72) Inventors: Kwang Ho Choi, Yongin-si (KR); Wang Byung Chae, Yongin-si (KR); Hyung Mo Koo, Suwon-si (KR); Kyung Hoon Kim, Suwon-si (KR); Kyu Sang Park, Pyeongtaek-si (KR); Hyun Woo Park, Suwon-si (KR); Seung Ho Hong, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 37 days.

(21) Appl. No.: 15/118,247

(22) PCT Filed: Feb. 10, 2015

(86) PCT No.: PCT/KR2015/001325
§ 371 (c)(1),
(2) Date: Aug. 11, 2016

(87) PCT Pub. No.: WO2015/167116
PCT Pub. Date: Nov. 5, 2015

(65) Prior Publication Data

US 2017/0146249 A1 May 25, 2017

(30) Foreign Application Priority Data

Apr. 30, 2014 (KR) ..... 10-2014-0052780
Oct. 31, 2014 (KR) ..... 10-2014-0149754
Jan. 30, 2015 (KR) ..... 10-2015-0014959

(51) Int. Cl.
*F25D 23/12* (2006.01)
*F24F 1/24* (2011.01)
*F24F 13/20* (2006.01)

(52) U.S. Cl.
CPC ..... *F24F 1/24* (2013.01); *F24F 13/20* (2013.01)

(58) Field of Classification Search
CPC ..... G06F 1/20
(Continued)

(56) References Cited

U.S. PATENT DOCUMENTS

2011/0180227 A1 7/2011 Anglin
2012/0193081 A1 8/2012 Kao et al.
2012/0312046 A1 12/2012 Kim et al.

FOREIGN PATENT DOCUMENTS

JP 2000-304304 11/2000
JP 2008-101862 5/2008
(Continued)

OTHER PUBLICATIONS

International Search Report dated Apr. 29, 2015 in corresponding International Patent Application No. PCT/KR2015/001325.
(Continued)

*Primary Examiner* — Melvin Jones
(74) *Attorney, Agent, or Firm* — Staas & Halsey LLP

(57) ABSTRACT

Embodiments of the present disclosure relate to an outdoor unit of an air conditioner configured to cool a heating unit by making contact with the heating unit, a cooling unit applied thereto, and a method for manufacturing the cooling unit. An outdoor unit of an air conditioner comprises a compressor configured to compress refrigerant; a condenser configured to condense the refrigerant discharged from the compressor; a control box provided with an electronic component configured to control an outdoor unit of an air conditioner; and
(Continued)

a cooling unit configured to cool a heating unit by making contact with the heating unit of the electronic component, wherein the cooling unit comprises a heat radiating member having one side thereof make contact with the heating unit; and a refrigerant pipe extended by penetrating through the heat radiating member and in which refrigerant is moved.

14 Claims, 14 Drawing Sheets

(58) Field of Classification Search
USPC ..... 62/259.2, 498, 509, 515
See application file for complete search history.

(56) References Cited

FOREIGN PATENT DOCUMENTS

| | | | |
|---|---|---|---|
| JP | 2008101862 A | * | 5/2008 |
| JP | 2011-99577 | | 5/2011 |
| KR | 20-2013-0003429 | | 6/2013 |

OTHER PUBLICATIONS

European Partial Supplementary Search Report dated Aug. 17, 2017 in corresponding European Patent Application No. 15785655.0.
Extended European Search Report dated Nov. 22, 2017 in corresponding European Patent Application No. 15785655.0, 14 pgs.

* cited by examiner

OUTDOOR UNIT OF AIR CONDITIONER, COOLING UNIT APPLIED THERETO, AND METHOD FOR MANUFACTURING COOLING UNIT

CROSS-REFERENCE TO RELATED APPLICATIONS

This application is a U.S. national stage application of the PCT international application PCT/KR2015/001325, filed on Feb. 10, 2015 and claims the benefits of Korean Patent Application No. 10-2014-0052780, filed on Apr. 30, 2014, Korean Patent Application No. 10-2014-0149754, filed on Oct. 31, 2014, and Korean Patent Application No. 10-2015-0014959, filed on Jan. 30, 2015, respectively, the contents of which are incorporated herein by reference.

TECHNICAL FIELD

Embodiments of the present disclosure relate to an outdoor unit of an air conditioner configured to cool a heating unit by making contact with the heating unit, a cooling unit applied thereto, and a method for manufacturing the cooling unit.

BACKGROUND ART

An air conditioner is an apparatus, which generally uses a refrigeration cycle to adjust temperature, humidity, flow and distribution of ambient air to levels proper for human activities and to remove dust from the air. The air conditioner includes an evaporator configured to cool ambient air by evaporating refrigerant, a compressor configured to compress refrigerant, which is passed through the evaporator and in a gaseous state, to be a high temperature and a high pressure, a condenser configured to condense refrigerant, which is compressed by passing through the compressor and in a gaseous state, to have a room temperature to be in a liquid state, and an expansion device configured to decompress high pressure liquid refrigerant, which is passed through the condenser.

Air conditioners may be divided into a split type air conditioner and an integrated type air conditioner, wherein the split type air conditioner includes an indoor unit installed in the indoor and configured to suction indoor air and perform heat exchange with refrigerant, and then discharge the heat-exchanged air to the indoor and an outdoor unit configured to perform heat exchange between refrigerant introduced from the indoor unit and the outdoor air so that the refrigerant is in a state of capable of performing heat exchange with the indoor air, again and configured to supply the changed refrigerant to the indoor unit. In the outdoor unit, the compressor and the condenser are typically installed.

In the outdoor unit, a control box including an electronic component configured to control the outdoor unit is provided. The electronic component may generate a heat caused by an operation thereof, and the heating may effect on a performance of the electronic component. Therefore, a cooling device may be provided in the outdoor unit to cool the heated electronic component.

DISCLOSURE

Technical Problem

Therefore, it is an aspect of the present disclosure to provide an outdoor unit of an air conditioner having an improved structure to effectively cool a heating unit, and a cooling unit applied thereto.

It is another aspect of the present disclosure to provide an outdoor unit of an air conditioner having an improved structure to improve the heat exchange efficiency by increasing an area in which a refrigerant pipe is in contact with a heat radiating member configured to cool a heating unit, and a cooling unit applied thereto.

It is another aspect of the present disclosure to provide a method for manufacturing a cooling unit configured to prevent a damage of a refrigerant pipe when manufacturing a heat radiating member in a state in which the refrigerant pipe is inserted thereinto.

Technical Solution

In accordance with one aspect of the present disclosure, an outdoor unit of an air conditioner comprises a compressor configured to compress refrigerant; a condenser configured to condense the refrigerant discharged from the compressor; a control box provided with an electronic component configured to control an outdoor unit of an air conditioner; and a cooling unit configured to cool a heating unit by making contact with the heating unit of the electronic component, wherein the cooling unit may comprise a heat radiating member having one side thereof make contact with the heating unit; and a refrigerant pipe extended by penetrating through the heat radiating member and in which refrigerant is moved.

The refrigerant pipe may allow the refrigerant discharged from the condenser to be passed inside thereof.

The control box may further comprise a case having a space in which the electronic component is placed, wherein the heat radiating member may comprise a body placed in an outer side of the case; and a contact unit provided in one side of the body and configured to be in contact with the heating unit by penetrating through the case.

The body and the refrigerant pipe may be provided in a state of being coated.

The refrigerant pipe may be extended by penetrating through the body.

The outdoor unit of an air conditioner may further comprise an expansion device configured to expand the refrigerant condensed by the condenser, wherein the refrigerant pipe may allow the refrigerant discharged from the expansion device to be passed inside thereof.

The heat radiating member may comprise aluminum.

In accordance with another aspect of the present invention, a cooling unit configured to cool a heating unit placed inside of an outdoor unit of an air conditioner, the cooling unit comprises a heat radiating member having one side thereof make contact with the heating unit; and a refrigerant pipe coupled to the heat radiating member and in which refrigerant is moved, wherein the refrigerant pipe may be extended by penetrating through an inside of the heat radiating member.

The heating unit may comprise a heating unit of an electronic component placed inside of a case of a control box configured to control the outdoor unit of an air conditioner, wherein the heat radiating member may comprise a body placed in an outer side of the case; and a contact unit provided in one side of the body and configured to be in contact with the heating unit by penetrating through the case.

The refrigerant pipe may be extended by penetrating through the body.

The cooling unit may be detachably coupled to the case.

In accordance with another aspect of the present invention, there is provided a method for manufacturing cooling unit including a heat radiating member into which an entire or a portion of a refrigerant pipe is inserted, the method comprises disposing a refrigerant pipe inside of a mold; coupling a guide pin configured to prevent a deformation of a shape of the refrigerant pipe to the refrigerant pipe; and injecting a molten metal into the inside of the mold.

The molten metal may be injected into the inside of the mold so that the molten metal surrounds an entire or a portion of the refrigerant pipe.

The guide pin may be inserted into the inside of the refrigerant pipe.

The molten metal may be injected into the inside of the mold in a state in which the guide pin is inserted into the inside of the refrigerant pipe.

Advantageous Effects

In accordance with one aspect of the present disclosure, it may be possible to efficiently cool a heating unit by improving the heat exchange efficiency.

In accordance with another aspect of the present disclosure, it may be possible to improve an efficiency of the heat exchange between a heat radiating member and a refrigerant pipe by increasing an area in which the refrigerant pipe is in contact with the heat radiating member configured to cool a heating unit. Therefore, a cooling efficiency of the cooling unit may be improved.

In accordance with another aspect of the present disclosure, it may be possible to reduce manufacturing cost by simplifying a manufacturing process of a cooling unit.

In accordance with another aspect of the present disclosure, it may be possible to prevent a damage of a refrigerant pipe inserted into a heat radiating member during a manufacturing process of a cooling unit.

DESCRIPTION OF DRAWINGS

These and/or other aspects of the present disclosure will become apparent and more readily appreciated from the following description of the embodiments, taken in conjunction with the accompanying drawings of which.

BEST MODE

Figure 1A:
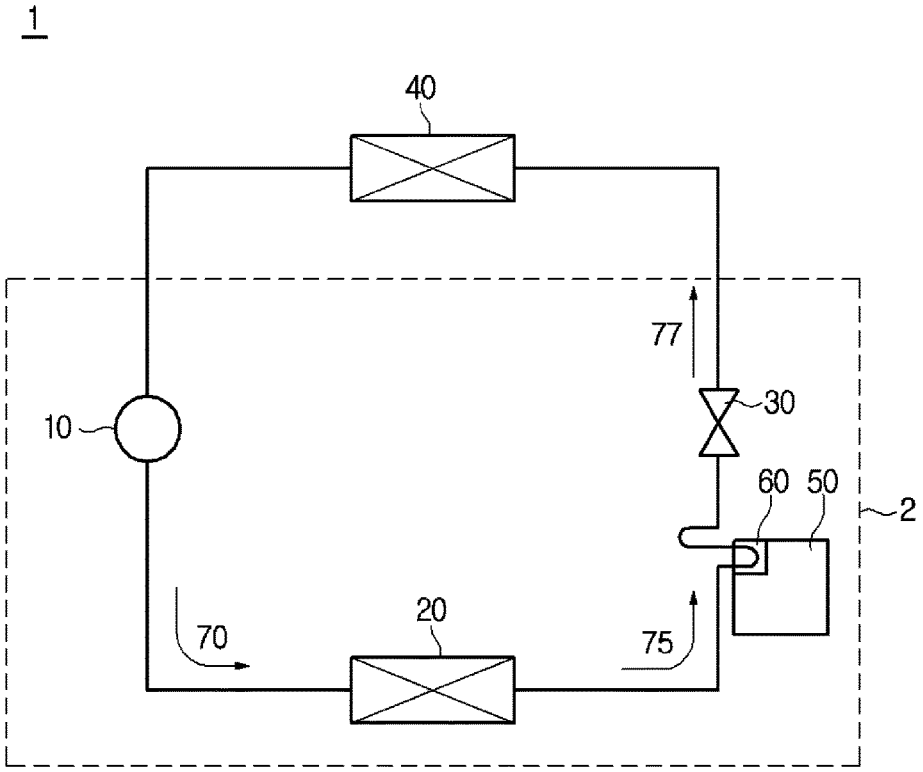
FIG. 1A is a view of a refrigeration cycle of an air conditioner having a cooling unit in accordance with an embodiment of the present disclosure.

Reference will now be made in detail to embodiments of the present disclosure, examples of which are illustrated in the accompanying drawings, wherein like reference numerals refer to like elements throughout.

Figure 1B:
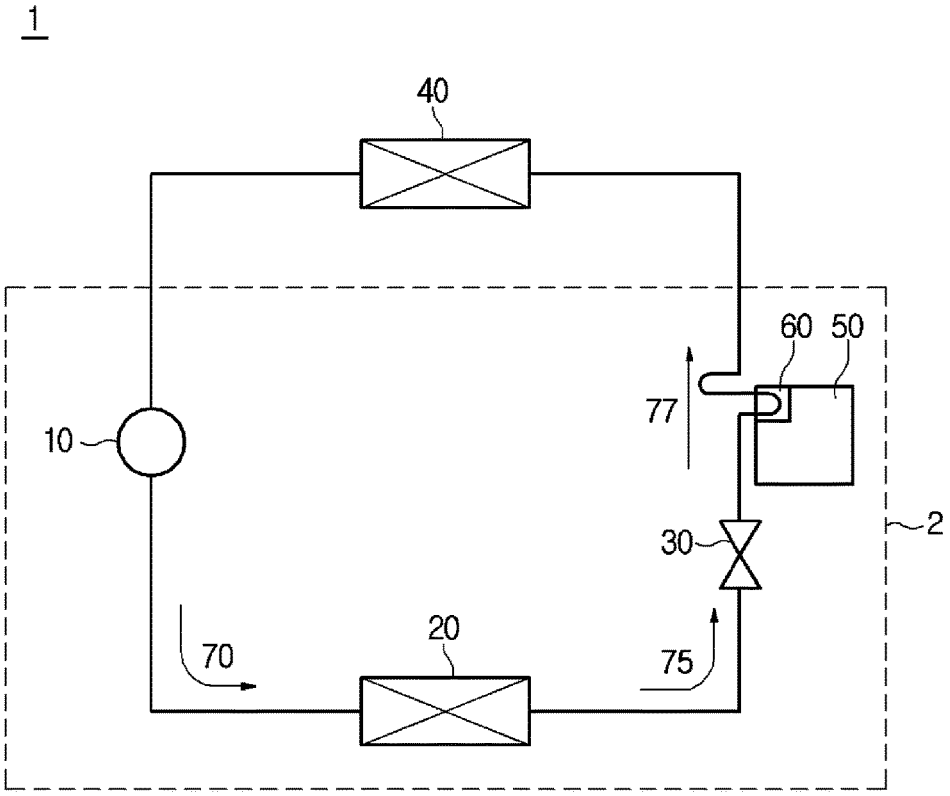
FIG. 1B is a view of a refrigeration cycle of an air conditioner in which a position of a cooling unit of FIG. 1A is modified.

FIG. 1A is a view of a refrigeration cycle of an air conditioner having a cooling unit in accordance with an embodiment of the present disclosure, and FIG. 1B is a view of a refrigeration cycle of an air conditioner in which a position of a cooling unit of FIG. 1A is modified.

Referring to FIG. 1A, a refrigeration cycle forming an air conditioner 1 may include a compressor 10; a condenser 20; an expansion device 30; and an evaporator 40. The refrigeration cycle may circulate a serial process having compression-condensation-expansion-evaporation, and may be configured to supply air at low temperature to the indoor after performing the heat exchange between air at a high temperature and refrigerant.

The compressor 10 may compress refrigerant gas 70 to be a high temperature and high pressure state, and discharge the refrigerant gas 70 at the high temperature and high pressure state, and the discharged refrigerant gas 70 may be introduced to the condenser 20. The condenser 20 may condense the compressed refrigerant to be a liquid state, and a heat may be radiated to the surrounding during a condensing process. Accordingly, the refrigerant may be condensed in the condenser 20 so that a temperature of the refrigerant is decreased.

The expansion device 30 may expand liquid high pressure refrigerant 75 that is condensed in the condenser 20, into liquid low pressure refrigerant 77. The evaporator 40 may evaporate the refrigerant expanded in the expansion device 30. The evaporator 40 may achieve the refrigerating effect by the heat exchange with an object to be cooled by using the evaporation latent heat of the refrigerant and then return low-temperature and low-pressure refrigerant gas to the compressor 10.

Through the cycle, the conditioned air may be supplied to the indoor.

The outdoor unit 2 of the air conditioner may include the compressor 10 and the condenser 20 in the refrigeration cycle. The expansion device 30 may be placed in one of the indoor unit and the outdoor unit 2, and the evaporator 40 may be placed in the indoor unit.

The cooling unit 60 may be installed between the condenser 20 and the expansion device 30 so that the refrigerant 75 passed through the condenser 20 is introduced thereto. Alternatively, as illustrated in FIG. 1B, the cooling unit 60 may be installed between the expansion device 30 and the evaporator 40 so that the refrigerant 77 passed through the expansion device 30 is introduced thereto.

Figure 2:
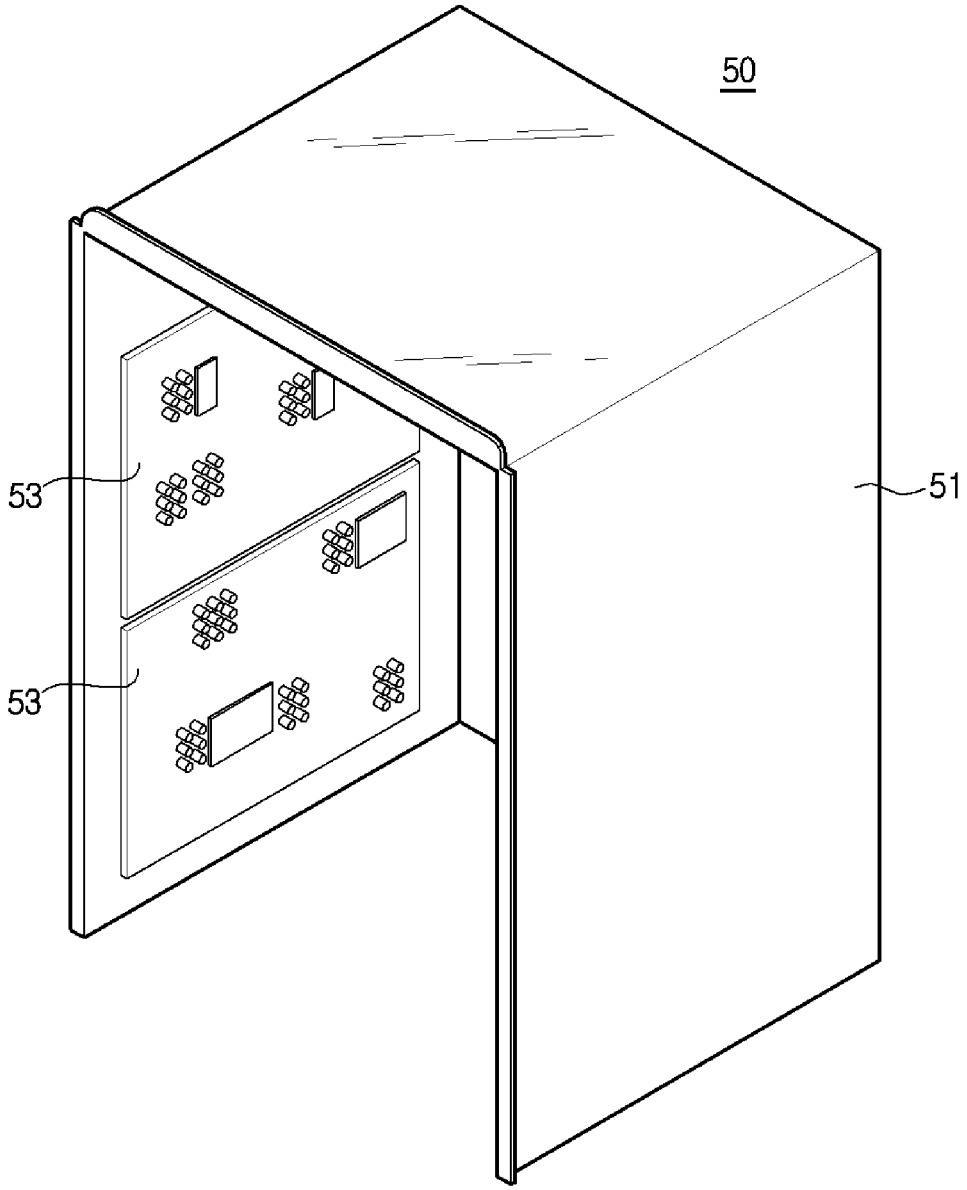
FIG. 2 is a perspective view of a control box in accordance with an embodiment of the present disclosure.

FIG. 2 is a perspective view of a control box in accordance with an embodiment of the present disclosure.

Referring to FIG. 2, the outdoor unit 2 of the air conditioner may further include a control box 50. The control box 50 may control an operation of the outdoor unit 2 of the air conditioner.

The control box 50 may include a case 51 and an electronic component 53.

The case 51 may be placed on one side of the inside of the outdoor unit 2 of the air conditioner. In the outdoor unit 2 of the air conditioner, the case 51 may divide a space in which the electronic component 53 is placed.

The electronic component 53 may be installed in the inside of the case 51. According to an embodiment, the electronic component 53 may be provided in one side wall of the inside of the case 51.

The electronic component 53 may be implemented by a printed circuit board in which a circuit element is embedded. The electronic component 53 may include an inverter controller, an EMI, and a reactor. The inverter controller may control the compressor 10 so that the compressor 10 is driven at a high speed or a low speed, according to conditions of the indoor in which the air conditioner 1 is installed, or a user's operation.

The electronic component 53 may generate a heat during an operation. In recent, in accordance with the development of the technology, the electronic component 53 may perform more and more functions. Accordingly, it is possible to increase a power consumption of the electric component 53, which results in generating more and more heat in the electric component 53.

In the electronic component 53, there may be an inoperable state or malfunctions caused by a heat. In addition, a durability of the electronic component 53 may be reduced and an operational degradation of the electronic component 53 may occur by the increase of the temperature caused by the generated heat. To prevent this, a cooling unit 60 configured to cool the electronic component 53 may be provided.

Hereinafter the cooling unit 60 according to an embodiment of the present disclosure will be described in details.

Figure 3:
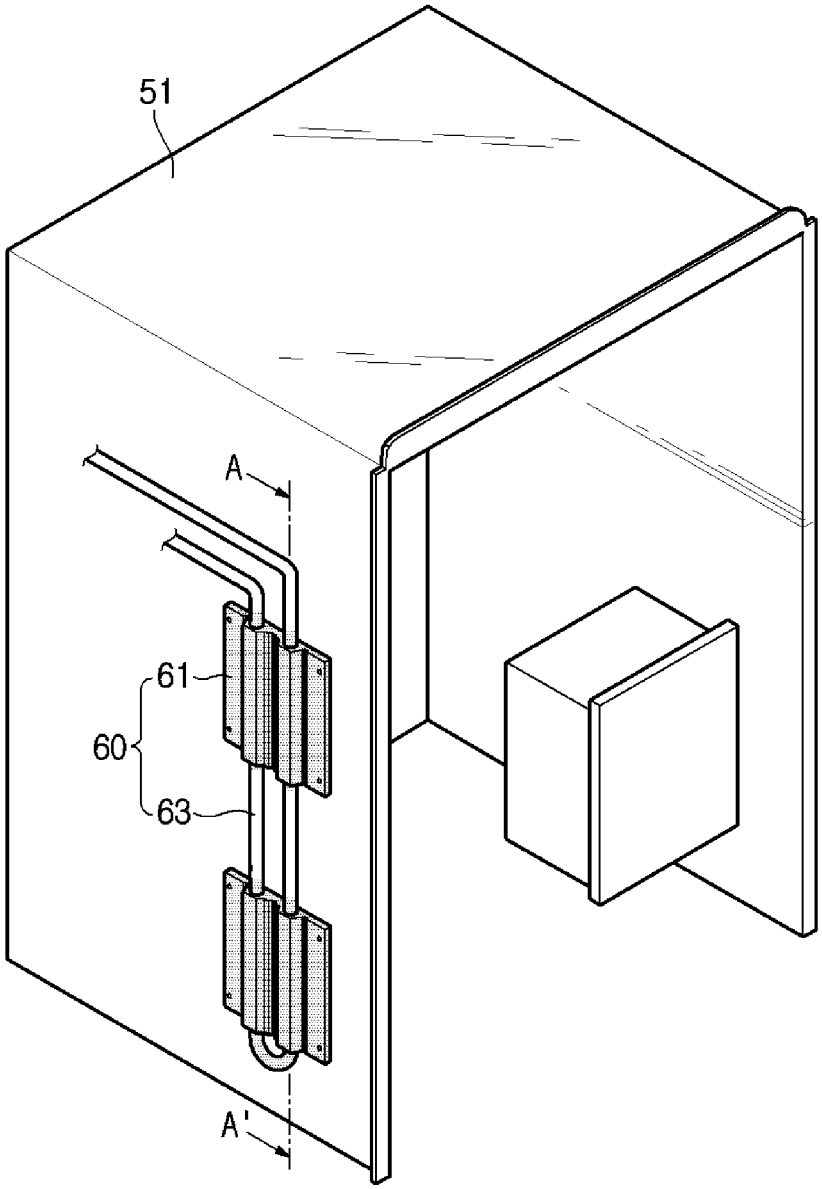
FIG. 3 is a perspective view of a control box in which a cooling unit is installed in accordance with an embodiment of the present disclosure.
Figure 4:
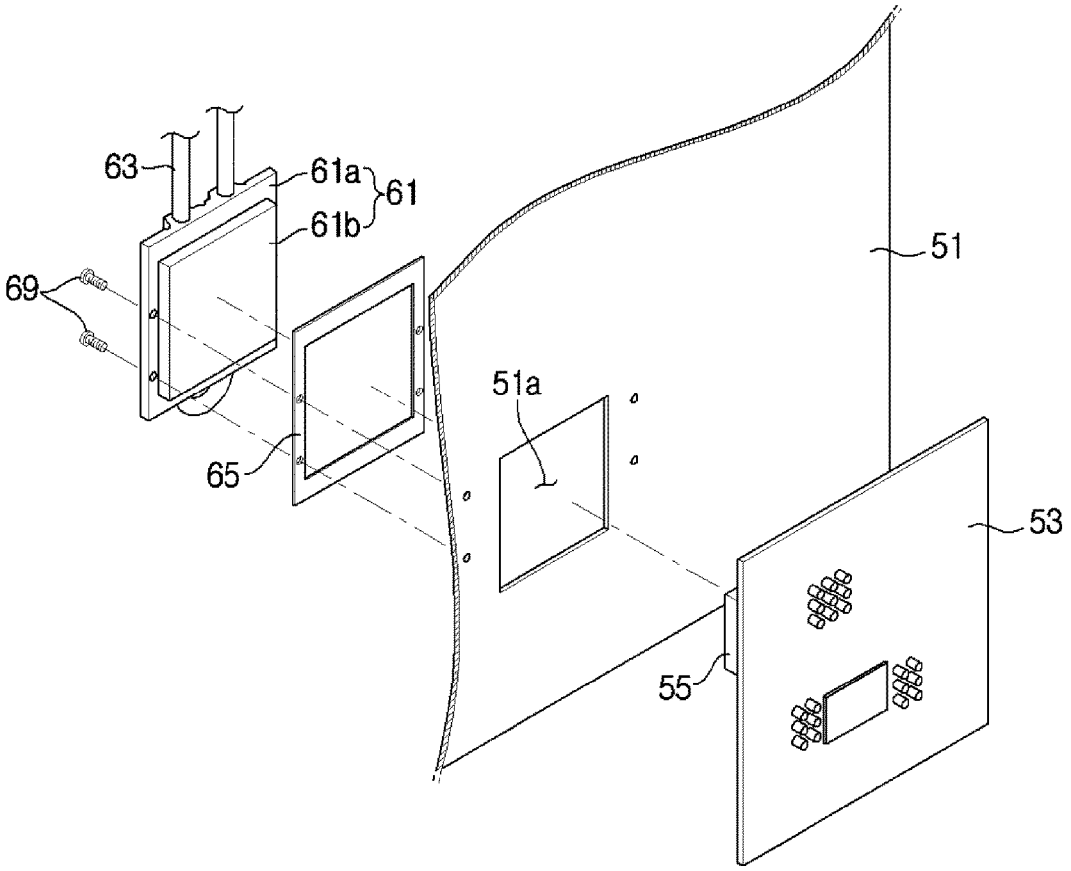
FIG. 4 is an exploded-perspective view of a control box in which a cooling unit is installed in accordance with an embodiment of the present disclosure.
Figure 5:
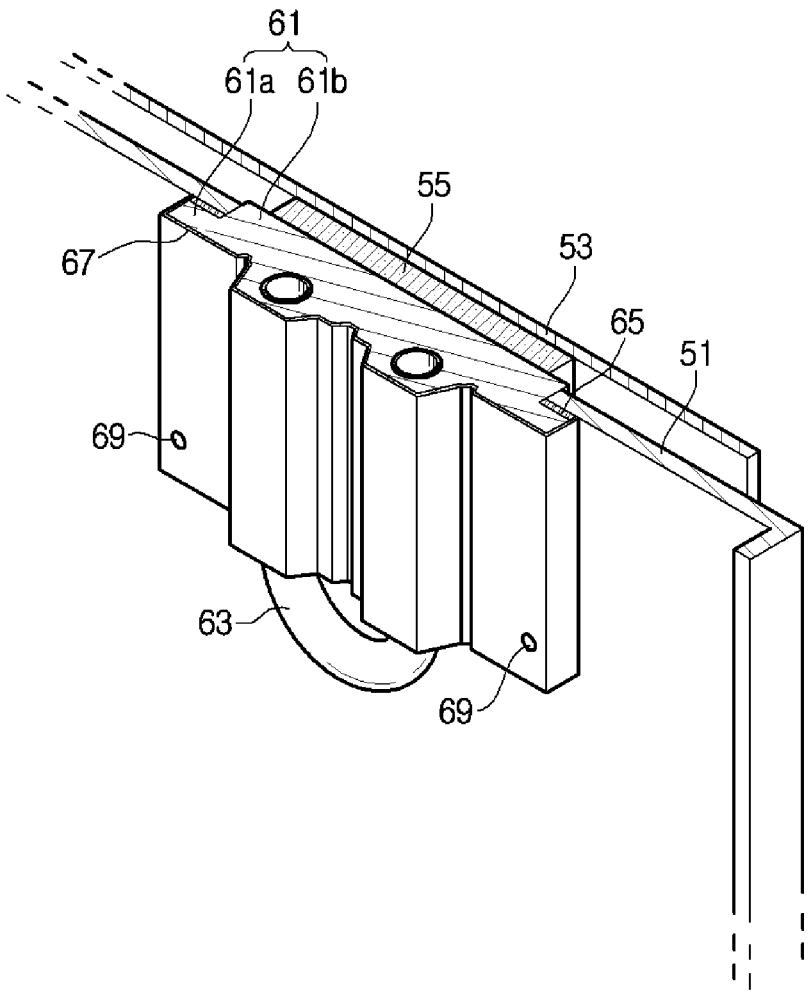
FIG. 5 is a partial cross-sectional view of a control box in which a cooling unit is installed in accordance with an embodiment of the present disclosure.
Figure 6:
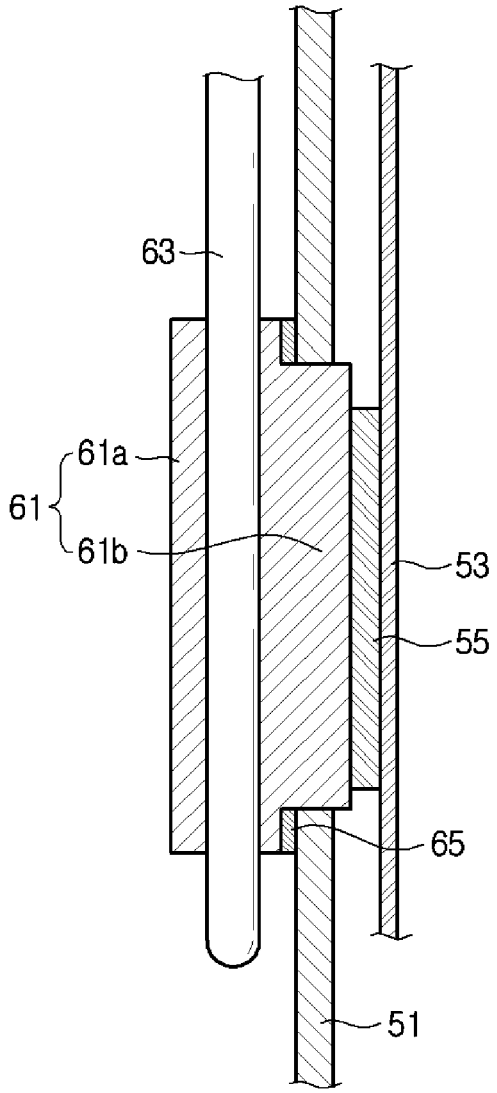
FIG. 6 is a sectional view taken along line A-A' of FIG. 3, and more particularly illustrating a cross sectional view of a control box in which a cooling unit is installed.

FIG. 3 is a perspective view of a control box in which a cooling unit is installed in accordance with an embodiment of the present disclosure, FIG. 4 is an exploded-perspective view of a control box in which a cooling unit is installed in accordance with an embodiment of the present disclosure, FIG. 5 is a partial cross-sectional view of a control box in which a cooling unit is installed in accordance with an embodiment of the present disclosure, and FIG. 6 is a sectional view taken along line A-A' of FIG. 3, and more particularly illustrating a cross sectional view of a control box in which a cooling unit is installed.

As illustrated in FIGS. 3 to 6, the outdoor unit 2 of the air conditioner may further include the cooling unit 60.

The cooling unit 60 may cool a heating unit 55 placed in the inside of the outdoor unit 2. The cooling unit 60 may perform a heat-exchange by directly making contact with the heating unit 55. Through this, a heat of the heating unit 55 may be delivered to the cooling unit 60 so that the heating unit 55 is cooled down. According to an embodiment, the heating unit 55 may include a heating unit 55 that is included in the electronic component 53 and placed in the inside of the control box 50. Hereinafter a case in which the cooling unit 60 cools the heating unit 55 of the electronic component 53 will be described as an example.

The cooling unit 60 may be installed on the outside of the control box 50. The cooling unit 60 may penetrate through the control box 50 to directly make contact with the heating unit 55 of the electronic component 53. The cooling unit 60 may be detachably installed in the control box 50. As illustrated in FIGS. 3 and 4, the cooling unit 60 may be screw-coupled 69 to the case 51 so that the cooling unit 60 may be detachable from the case 51.

The cooling unit 60 may include a heat radiating member 61 and a refrigerant pipe 63.

The heat radiating member 61 may be provided such that one side thereof is in contact with the heating unit 55 of the electronic component 53. The heat radiating member 61 may be installed on the outside of the control box 50 to make contact with the heating unit 55 of the electronic component 53 by penetrating through the control box 50. The heat radiating member 61 may be detachably coupled to the control box 50. The heat radiating member 61 may be screw-coupled 69 to the control box 50. According to an embodiment, the heat radiating member 61 may include aluminum.

The heat radiating member 61 may include a body 61*a* and a contact unit 61*b*. The heat radiating member 61 may be formed as a single member including the body 61*a* and the contact unit 61*b*. A manufacturing method of the heat radiating member 61 will be described in the following.

The body 61*a* may be installed on the outside of the control box 50. The body 61*a* may be detachably coupled to the outside of the control box 50. One side of the body 61*a* may be screw-coupled 69 to the control box 50. Any portion of the body 61*a* that is not overlapped with the contact unit 61*b* may be screw-coupled 69 to the control box 50.

The body 61*a* may be coupled to the refrigerant pipe 63. The body 61*a* may perform a heat exchange with the refrigerant pipe 63 by making contact with the refrigerant pipe 63. According to an embodiment, the body 61*a* may surround a portion or an entire of the refrigerant pipe 63.

The contact unit 61*b* may be provided on one side of the body 61*a*. The contact unit 61*b* may be extended from the body 61*a* inward of the control box 50. The contact unit 61*b* may make contact with the heating unit 55 placed in the inside of the control box 50 by penetrating through the case 51.

As illustrated in FIG. 4, the contact unit 61*b* may be extended inward of the case 51 by passing through a through hole 51*a* that is placed in one side of the case 51. The contact unit 61*b* may have a cross section corresponding to the through hole 51*a* so that the contact unit 61*b* is inserted into the through hole 51*a*. The contact unit 61*b* may have a smaller cross section than that of the body 61*a*.

The contact unit 61*b* may perform a heat exchange by making contact with the heating unit 55 placed inside of the control box 50. The contact unit 61*b* may be provided to have a lower temperature than the heating unit 55 by the refrigerant pipe 63 that makes contact with the body 61*a*. Therefore, the contact unit 61*b* may receive a heat from the heating unit 55 so as to cool the heating unit 55.

The refrigerant pipe 63 may perform a heat exchange by making contact with the heat radiating member 61. According to an embodiment, the refrigerant pipe 63 may be extended to penetrate through the inside of the heat radiating member 61. Accordingly, the refrigerant pipe 63 may increase an area of making contact with the heat radiating member 61. Therefore, the efficiency of the heat exchange between the refrigerant pipe 63 and the heat radiating member 61 may be improved. The refrigerant pipe 63 may include copper.

Refrigerant may be moved inside of the refrigerant pipe 63. The refrigerant may be provided as a fluid state at a lower temperature than that of the heating unit 55. The refrigerant may circulate the refrigerant pipe 63 in a state of receiving a heat. Accordingly, the refrigerant may maintain the heat radiating member 61 at a certain temperature.

As illustrated in FIG. 1A, the refrigerant pipe 63 may be provided to allow the liquid refrigerant that is condensed by the condenser 20 to be moved. The refrigerant gas 70 at a high temperature and high pressure may be condensed in the condenser 20 so that a temperature of the refrigerant gas 70 may be decreased. The low temperature liquid refrigerant 75 that is passed through the condenser 20 may be moved to the cooling unit 60. The cooling unit 60 may cool the heating unit 55 by using the low temperature liquid refrigerant 75.

Alternatively, as illustrated in FIG. 1B, the refrigerant pipe 63 may be provided to allow the low temperature and low pressure refrigerant 77 that is expanded by the expansion device 30 to be moved. Particularly, the low temperature and low pressure refrigerant 77 passed through the expansion device 30 may be moved to the cooling unit 60. The cooling unit 60 may cool the heating unit 55 by using the low temperature and low pressure refrigerant 77.

A sealing member 65 may be provided between the body 61*a* and the case 51. The sealing member 65 may seal the body 61*a* and the case 51 so that a rain or foreign material may be prevented from being introduced between the body 61*a* and the case 51.

The cooling unit 60 may be provided in a state of being coated. Particularly, the body 61*a* of the cooling unit 60 may be provided to be coated. As illustrated in FIG. 5, a coating layer 67 may be formed on an outer side of the body 61*a*. The coating layer 67 may typically include epoxy material. Accordingly, the body 61*a* that is placed on the outside of the case 51 may be coated to prevent corrosion. As illustrated in FIG. 3, the cooling unit 60 may be provided such that the body 61*a* and a portion of the refrigerant pipe 63 that is placed adjacent to the body 61*a* (a shade part of FIG. 3) are coated.

A plurality of the cooling unit 60 may be provided. Particularly, the cooling unit 60 may be provided in plural according to the type, the number and the position of the heating unit placed in the outdoor unit 2.

Hereinafter a method for manufacturing the cooling unit 60 will be described in details.

Figure 7:
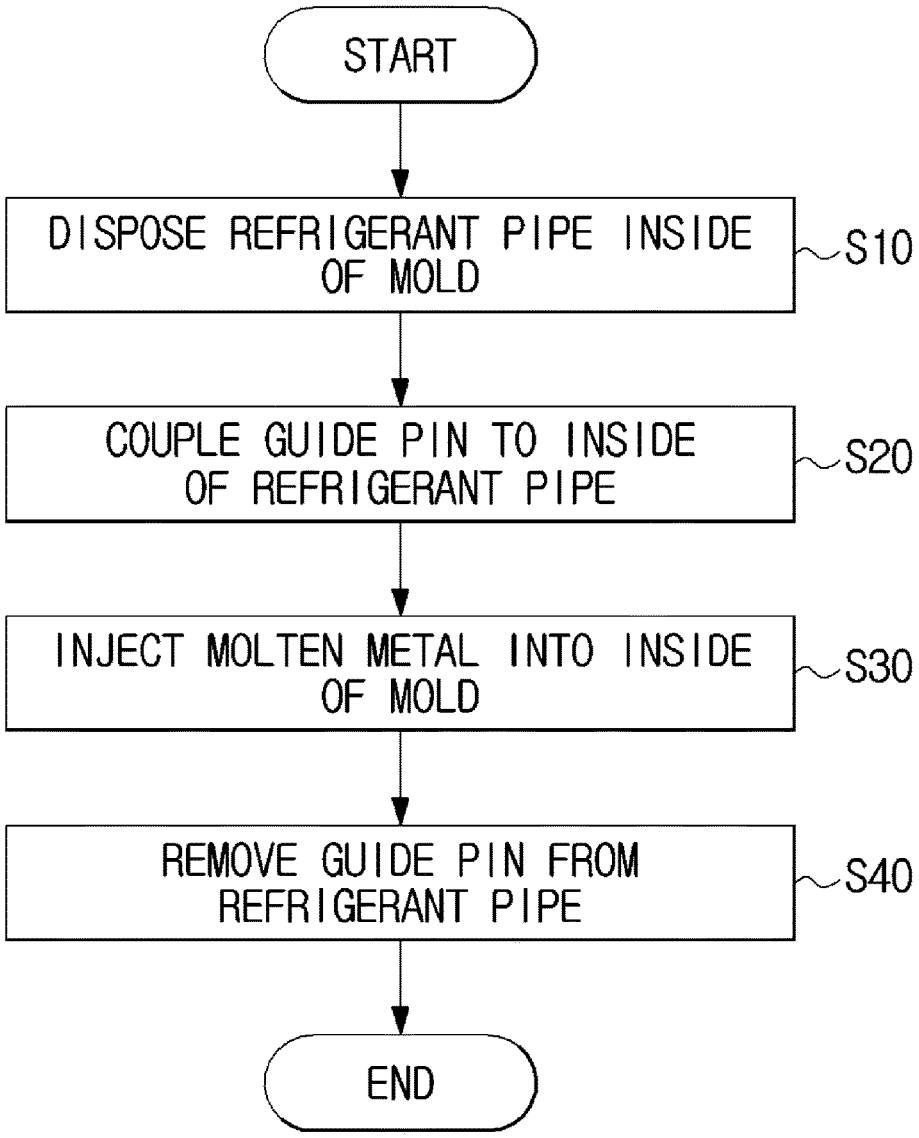
FIG. 7 is a flow chart of a method for manufacturing a cooling unit in accordance with an embodiment of the present disclosure.

FIG. 7 is a flow chart of a method for manufacturing a cooling unit in accordance with an embodiment of the present disclosure.

Referring to FIG. 7, a method for manufacturing a cooling unit may include disposing a refrigerant pipe in a mold (10), coupling a guide pin to the inside of the refrigerant pipe (20), injecting a molten metal into the inside of the mold (30), and removing the guide pin from the refrigerant pipe (40).

In accordance with an embodiment, the cooling unit 60 may be provided such that a portion or an entire of the refrigerant pipe 63 is inserted into the heat radiating member 61. The cooling unit 60 may be manufactured by a die casting technology. Particularly, the die casting technology may include disposing the refrigerant pipe 63 inside of a mold 91 (refer to FIG. 8) and injecting a molten metal 99 (refer to FIG. 11) into a casting space 94 (refer to FIG. 9).

FIGS. 8 to 13 are views of a process of manufacturing a cooling unit in accordance with an embodiment of the present disclosure.

Figure 8:
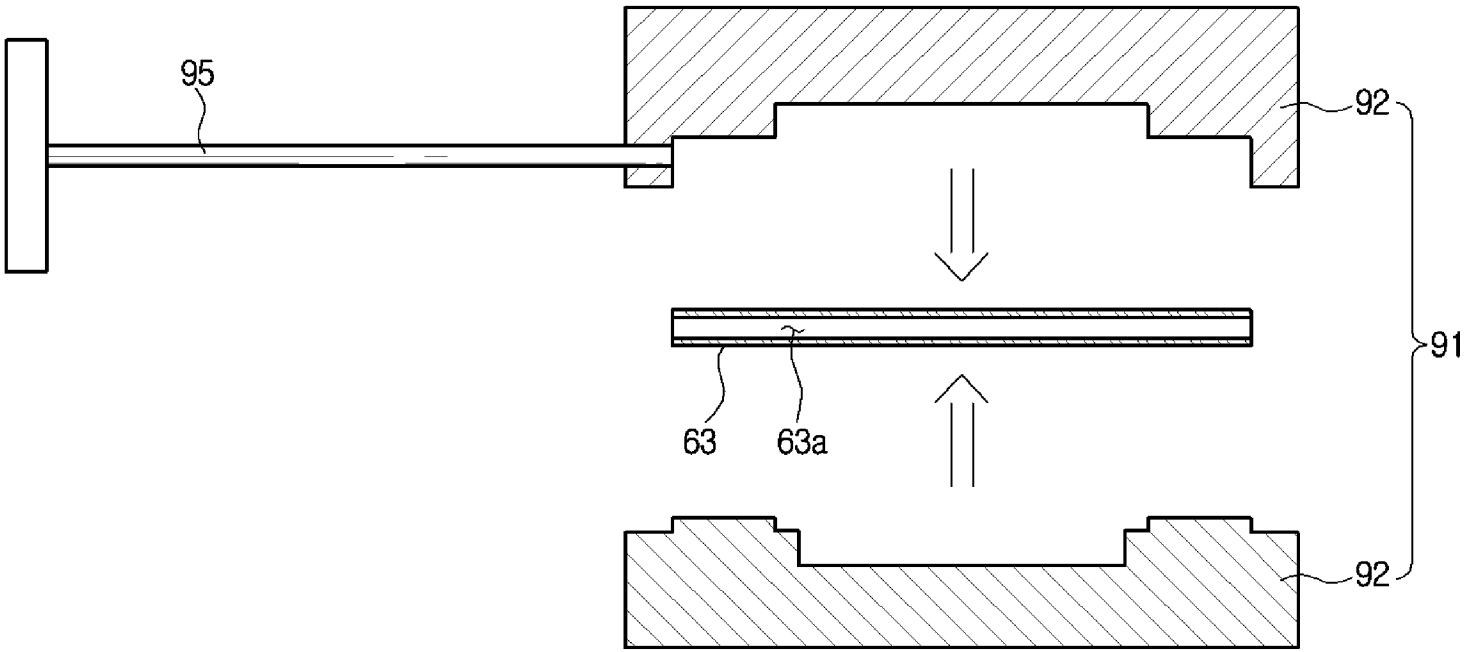
FIGS. 8 to 13 are views of a process of manufacturing a cooling unit in accordance with an embodiment of the present disclosure.
Figure 9:
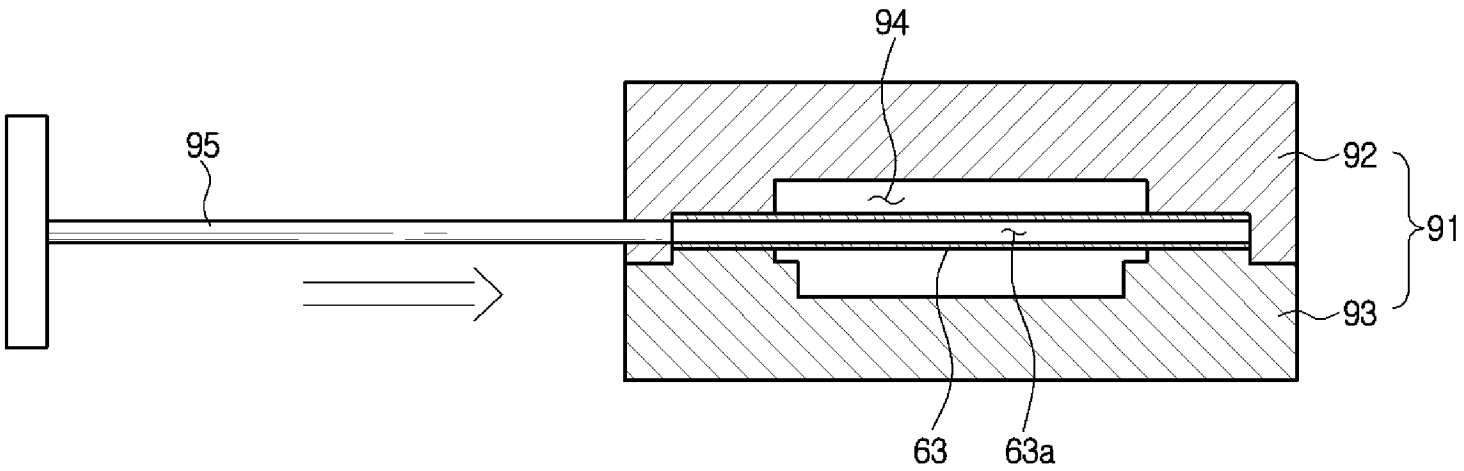

As illustrated in FIGS. 8 and 9, the refrigerant pipe may be disposed inside of a mold (10). The mold 91 may include an upper mold 92 and a lower mold 93. The upper mold 92 and the lower mold 93 may be coupled to each other to form the casting space 94 inside of the mold 91. The upper mold 92 and the lower mold 93 may be separated from each other, as illustrated in FIG. 8, or coupled to each other to form the casting space 94, as illustrated in FIG. 9.

At least one portion of the refrigerant pipe 63 may be placed in the casting space 94 formed inside of the mold 91. By disposing the refrigerant pipe 63 in the casting space 94 formed inside of the mold 91, the molten metal 99 (refer to FIG. 11) may be injected into the casting space 94 to surround at least one portion of the refrigerant pipe 63.

Figure 10:
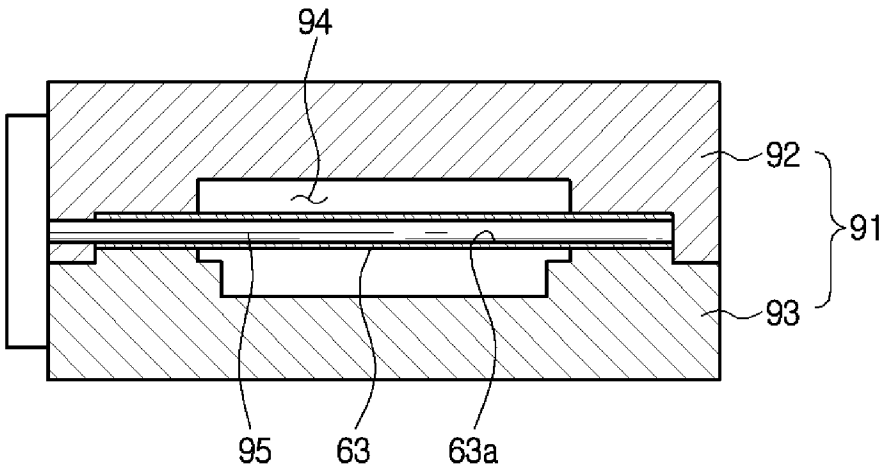

As illustrated in FIGS. 9 and 10, a guide pin may be coupled to the inside of the refrigerant pipe (20). When the guide pin is coupled to the inside of the refrigerant pipe (20), the guide pin may be coupled to the refrigerant pipe 63 before injecting the molten metal 99 (refer to FIG. 11) into the casting space 94. According to an embodiment, the guide pin 95 may be coupled to the refrigerant pipe 63 such that the guide pin 95 is inserted into an internal flow path 63*a* formed inside of the refrigerant pipe 63. Accordingly, the deformation and the damage of the refrigerant pipe 63 may be prevented wherein the deformation and the damage may be caused by the molten metal 99 (refer to FIG. 11) having a high temperature that is injected into the casting space 94.

The guide pin 95 may be formed with a metal material. The guide pin 95 may be formed with a metal material having a higher melting point than that of the refrigerant pipe 63 formed with copper (Cu).

The guide pin 95 may be inserted into the internal flow path 63*a* of the refrigerant pipe 63. A cross section of the guide pin 95 may be identical to a cross section of the internal flow path 63*a* of the refrigerant pipe 63. Therefore, in the inside of the refrigerant pipe 63, the guide pin 95 may be inserted into the internal flow path 63*a* of the refrigerant pipe 63 to prevent a deformation of the refrigerant pipe 63.

Figure 11:
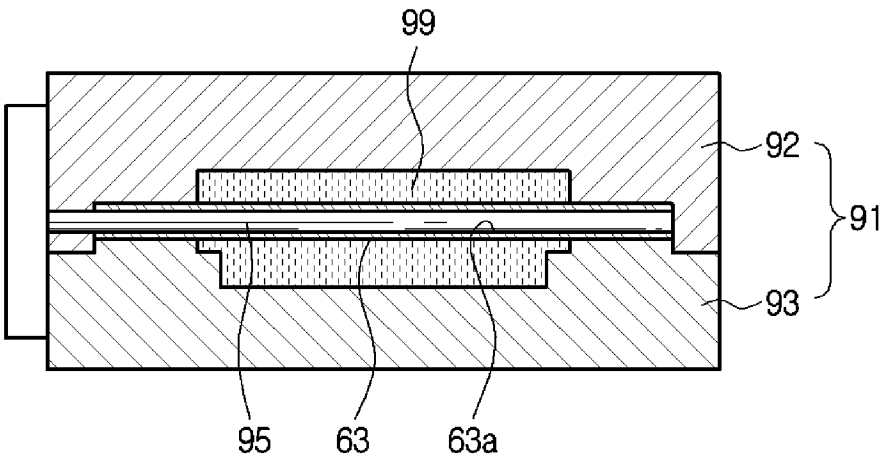

As illustrated in FIG. 11, when the guide pin 95 is coupled to the inside of the refrigerant pipe 63, the molten metal may be injected into the inside of the mold (30). Particularly, the molten metal 99 may be injected into the casting space 94 (refer to FIG. 10) formed in the mold 91.

The molten metal 99 (refer to FIG. 11) having a high temperature, which is then injected into the casting space 94, may have a temperature of from 600° C. to 700° C. The molten metal 99 may be aluminum. When injecting the molten metal 99 at a temperature of from 600° C. to 700° C. into the casting space 94, the refrigerant pipe 63 including copper may be deformed or damaged due to the temperature of the molten metal 99 and the injection pressure.

According to a method for manufacturing a cooling unit in accordance with an embodiment, although the molten metal 99 at a high temperature is injected, it may be possible to prevent the shape of the refrigerant pipe 63 from being deformed or damaged since the guide pin 95 is inserted into the inside of the refrigerant pipe 63.

Figure 12:
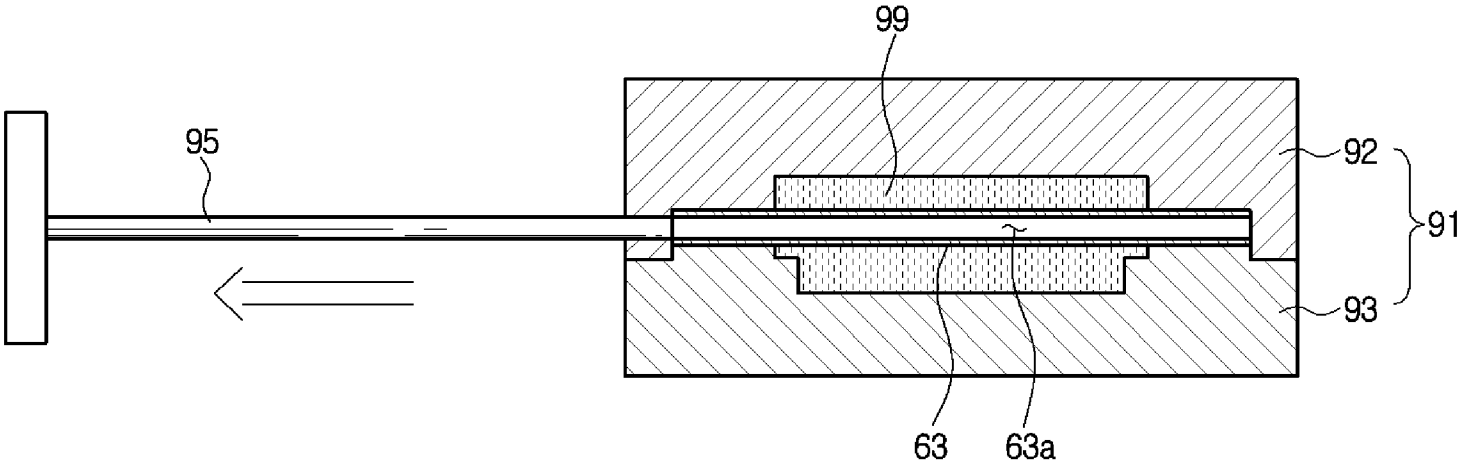

As illustrated in FIG. 12, after injecting the molten metal 99 into the inside of the mold, the guide pin may be removed from the refrigerant pipe (40). When injecting the molten metal 99 into the casting space 94 is completed, the guide pin 95 may be removed from the refrigerant pipe 63. The guide pin 95 may be removed from the refrigerant pipe 63 without the deformation or the damage of the refrigerant pipe 63, which is caused by the molten metal 99 injected into the casting space 94.

Figure 13:
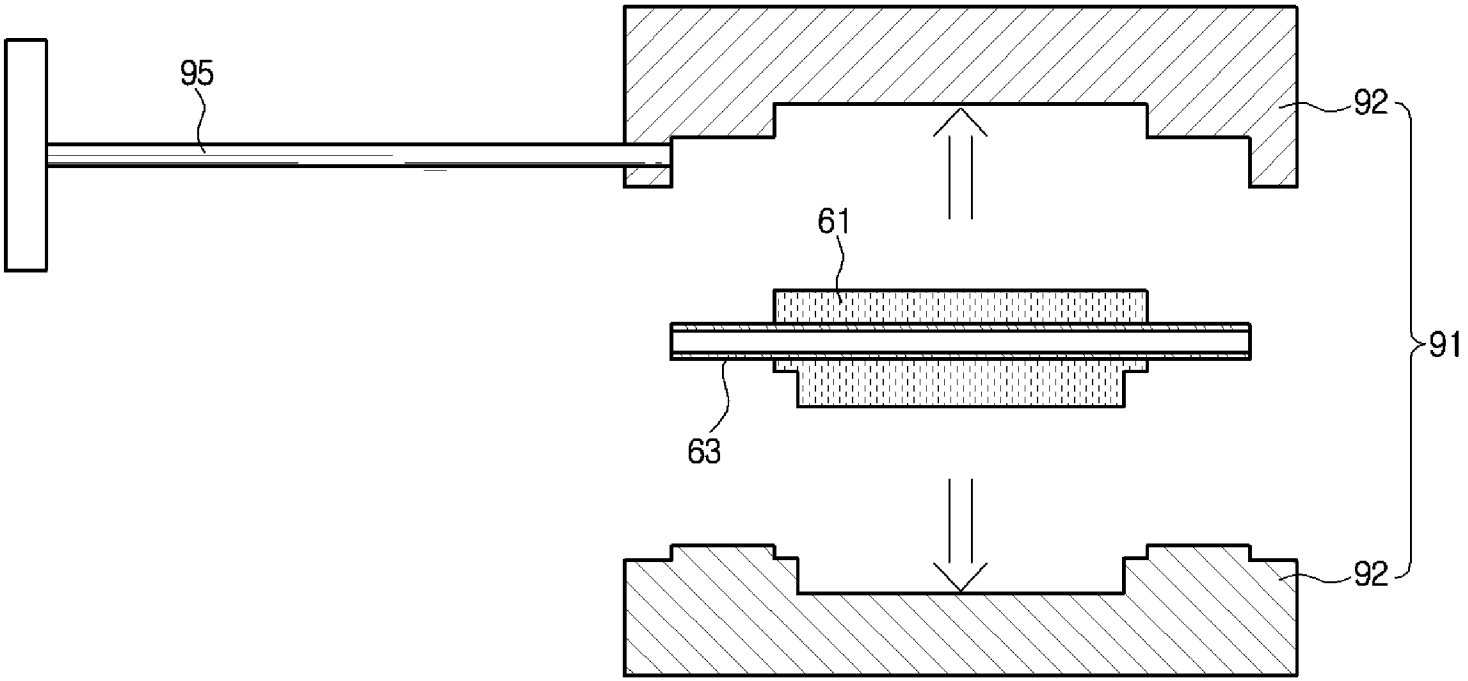

As illustrated in FIG. 13, when the guide pin 95 is removed from the refrigerant pipe 63, the manufactured cooling unit 60 may be separated from the mold 91. The cooling unit 60 may be manufactured to have a shape in which the refrigerant pipe 63 is inserted into the heat radiating member 61 formed by solidified molten metal 99. According to the above mentioned method, the cooling unit 60 in accordance with an embodiment may be manufactured.

When the refrigerant pipe 63 is coupled to the heat radiating member 61 in a conventional manner, e.g. an indentation, a micro-space may be generated between the heat radiating member 61 and the refrigerant pipe 63. Therefore, when the heat radiating member 61 and the refrigerant pipe 63 do not completely make contact with each other, the efficiency of the heat exchange between the heat radiating member 61 and the refrigerant pipe 63 may be reduced.

However, as mentioned above, according to the die casing technology in which the molten metal 99 is injected to form the heat radiating member 61 in a state in which the refrigerant pipe 63 is placed in the inside of the mold 91, the cooling unit 60 may increase an area in which the heat radiating member 61 and the refrigerant pipe 63 are in contact with each other. Therefore, the efficiency of the heat exchange between refrigerant passing thorough the refrigerant pipe 63 and the heat radiating member 61 may be improved. In addition, the cooling efficiency of the cooling unit 60 may be improved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. An outdoor unit of an air conditioner comprising:

a compressor configured to compress refrigerant;

a condenser configured to condense the refrigerant discharged from the compressor;

a control box provided with an electronic component configured to control the outdoor unit of air conditioner, the control box including a case having a space in which the electronic component is placed; and a cooling unit configured to cool a heating unit of the electronic component by making contact with the heating unit, the cooling unit being detachably coupled to the case, wherein the cooling unit comprises a heat radiating member having one side thereof make contact with the heating unit, and a refrigerant pipe extended by penetrating through the heat radiating member and in which refrigerant is moved.

2. The outdoor unit of an air conditioner of claim 1, wherein the refrigerant pipe allows the refrigerant discharged from the condenser to be passed inside thereof.

3. The outdoor unit of an air conditioner of claim 1, wherein the heat radiating member comprises a body placed in an outer side of the case, and a contact unit provided in one side of the body and configured to be in contact with the heating unit by penetrating through the case.

4. An outdoor unit of an air conditioner comprising:

a compressor configured to compress refrigerant;

a condenser configured to condense the refrigerant discharged from the compressor;

a control box provided with an electronic component configured to control the outdoor unit of air conditioner, the control box including a case having a space in which the electronic component is placed; and a cooling unit configured to cool a heating unit of the electronic component by making contact with the heating unit, wherein the cooling unit comprises a heat radiating member having one side thereof make contact with the heating unit, and a refrigerant pipe extended by penetrating through the heat radiating member and in which refrigerant is moved, wherein the heat radiating member comprises a body placed in an outer side of the case, and a contact unit provided in one side of the body and configured to be in contact with the heating unit by penetrating through the case, and wherein the body and the refrigerant pipe are provided in a state of being coated.

5. The outdoor unit of an air conditioner of claim 3, wherein the refrigerant pipe is extended by penetrating through the body.

6. The outdoor unit of an air conditioner of claim 1, further comprising:

an expansion device configured to expand the refrigerant condensed by the condenser, wherein the refrigerant pipe allows the refrigerant discharged from the expansion device to be passed inside thereof.

7. The outdoor unit of an air conditioner of claim 1, wherein the heat radiating member comprises aluminum.

8. A cooling unit configured to cool a heating unit placed inside of an outdoor unit of an air conditioner, the cooling unit comprising:

a heat radiating member having one side thereof make contact with the heating unit; and a refrigerant pipe coupled to the heat radiating member and in which refrigerant is moved, wherein the refrigerant pipe is extended by penetrating through an inside of the heat radiating member, wherein the heating unit comprises a heating unit of an electronic component placed inside of a case of a control box configured to control the outdoor unit of the air conditioner, wherein the cooling unit is detachably coupled to the case.

9. The cooling unit of claim 8, wherein the heat radiating member comprises a body placed in an outer side of the case, and a contact unit provided in one side of the body and configured to be in contact with the heating unit by penetrating through the case.

10. The cooling unit of claim 9, wherein the refrigerant pipe is extended by penetrating through the body.

11. A method for manufacturing cooling unit including a heat radiating member into which an entire or a portion of a refrigerant pipe is inserted, the method comprising:

disposing a refrigerant pipe inside of a mold;

coupling a guide pin configured to prevent a deformation of a shape of the refrigerant pipe to the refrigerant pipe; and injecting a molten metal into the inside of the mold.

12. The method of claim 11, wherein the molten metal is injected into the inside of the mold so that the molten metal surrounds an entire or a portion of the refrigerant pipe.

13. The method of claim 11, wherein the guide pin is inserted into the inside of the refrigerant pipe.

14. The method of claim 13, wherein the molten metal is injected into the inside of the mold in a state in which the guide pin is inserted into the inside of the refrigerant pipe.

* * * * *